US010305259B2

(12) United States Patent
Lin

(10) Patent No.: US 10,305,259 B2
(45) Date of Patent: May 28, 2019

(54) CAR IGNITION DEVICE AND IGNITION ACCELERATOR

(71) Applicant: Electronic Design Land Trading GMBH, Apia (WS)

(72) Inventor: Hung-Yu Lin, New Taipei (TW)

(73) Assignee: ELECTRONIC DESIGN LAND TRADING GMBH, Apia (WS)

( * ) Notice: Subject to any disclaimer, the term of this patent is extended or adjusted under 35 U.S.C. 154(b) by 0 days.

(21) Appl. No.: 15/890,737

(22) Filed: Feb. 7, 2018

(65) Prior Publication Data

US 2019/0131774 A1 May 2, 2019

(30) Foreign Application Priority Data

Oct. 31, 2017 (CN) ..... 2017 1 1046926

(51) Int. Cl.
*H01T 13/05* (2006.01)
*H01R 13/53* (2006.01)

(52) U.S. Cl.
CPC ..... *H01T 13/05* (2013.01); *H01R 13/53* (2013.01)

(58) Field of Classification Search
None
See application file for complete search history.

(56) References Cited

U.S. PATENT DOCUMENTS 3,757,754 A * 9/1973 Wiegand ..... F02P 7/0672 123/146.5 A
4,485,796 A * 12/1984 Boyer ..... F02P 7/0675 123/146.5 A
5,291,872 A 3/1994 Ghaem
2012/0192624 A1 8/2012 Visser et al.

FOREIGN PATENT DOCUMENTS

CN 205400968 U 7/2016
TW 314274 U 8/1997

* cited by examiner

*Primary Examiner* — Ashok Patel
(74) *Attorney, Agent, or Firm* — Muncy, Geissler, Olds & Lowe, P.C.

(57) ABSTRACT

A car ignition device and an ignition accelerator are disclosed. The car ignition device includes a magnetic shielding conductive element, a spark plug and a magnetic element. The magnetic shielding conductive element has a first disposing portion and a second disposing portion. One end of the spark plug is disposed inside the first disposing portion and electrically connected with the magnetic shielding conductive element. The magnetic element is disposed at the second disposing portion, and has a north-seeking pole and a south-seeking pole. The north-seeking pole is located at one side of the magnetic element near the spark plug. The south-seeking pole is located at another side of the magnetic element away from the spark plug. The magnetic shielding conductive element shields a magnetic force of the magnetic element in a direction toward the spark plug. The invention has higher ignition efficiency.

15 Claims, 4 Drawing Sheets

CAR IGNITION DEVICE AND IGNITION ACCELERATOR

CROSS REFERENCE TO RELATED APPLICATIONS

This Non-provisional application claims priority under 35 U.S.C. § 119(a) on Patent Application No(s). 201711046926.4 filed in People's Republic of China on Oct. 31, 2017, the entire contents of which are hereby incorporated by reference.

BACKGROUND

Technical Field

The invention relates to an ignition device and an ignition accelerator, and more particularly to a car ignition device and an ignition accelerator having higher ignition efficiency.

Related Art

An existing ignition device, such as a car ignition device, generally includes a plug cap and a spark plug covered by the plug cap. When a sufficiently high voltage is applied, the electric field intensity between two electrodes on one end of the spark plug causes electrical breakdown on the insulation medium (e.g., oil gas) located between two electrodes to generate an electric arc and thus to ignite the oil gas to make the engine generate the power to move the car.

However, because the peak gap voltage upon the electrical breakdown is restricted to the applied control voltage, the electric arc cannot be generated more effectively and rapidly. Thus, all the oil gas cannot be ignited at a time, so that the combustion is incomplete and the poisoned carbon monoxide (CO) is exhausted. In addition, if the wires of the car are old, then the applied control voltage may be decreased and lower than the rating voltage. At this time, the insufficient electric field intensity disables the spark plug from generating the electric arc so that the car cannot be started or encounters the flame-out condition upon driving.

In addition, after the spark plug is used for a period of time, the high temperature caused by the electrical breakdown between the two electrodes melts portions of the electrodes to generate chips, which tend to be adhered to the electrodes, so that the gap (ignition distance) between the two electrodes is decreased, and the impedance between the two electrodes is enlarged. Thus, the gap voltage for ignition is insufficient or the current is too small, so that the point discharge effect is poor and the ignition efficiency is poor. More seriously, the car cannot be started or encounters the flame-out condition upon driving.

SUMMARY

An objective of the invention is to provide a car ignition device and an ignition accelerator having the higher peak gap voltage and ignition efficiency.

The car ignition device of the invention can make the oil gas be completely combusted, can reduce the exhausted harmful gas and increase the horse power. In addition, the ignition efficiency becomes better, and the car is less free from jittering upon idling. In addition, the ignition accelerator of the invention can shorten the ignition time and increase the ignition efficiency.

To achieve the above objective, the present disclosure discloses a car ignition device. The car ignition device comprises a magnetic shielding conductive, a spark plug, and a magnetic element. The magnetic shielding conductive element has a first disposing portion and a second disposing portion. The spark plug has one end disposed inside the first disposing portion, and electrically connected with the magnetic shielding conductive element. The magnetic element is disposed at the second disposing portion and has a north-seeking pole and a south-seeking pole, wherein the north-seeking pole is located at one side of the magnetic element near the spark plug, and the south-seeking pole is located at another side of the magnetic element away from the spark plug. The magnetic shielding conductive element shields a magnetic force of the magnetic element in a direction toward the spark plug.

In one embodiment, the first disposing portion comprises a slot.

In one embodiment, the second disposing portion has an outer peripheral surface, and the magnetic element is surroundingly disposed on the outer peripheral surface.

In one embodiment, the magnetic element is an annular body and has a through hole, and the second disposing portion passes through the through hole.

In one embodiment, the through hole of the magnetic element forms an inner circumferential surface, and the inner circumferential surface is in surface contact with the outer peripheral surface.

In one embodiment, the other end of the spark plug has two electrodes, and a gap is formed between the electrodes.

In one embodiment, the car ignition device further comprises a high-voltage power electrically connected with the magnetic shielding conductive element and the spark plug, wherein when the high-voltage power is in a power-on state, the spark plug generates an electric arc.

In one embodiment, the car ignition device further comprises a plug cap unit having a plug cap housing, wherein the high-voltage power and the magnetic shielding conductive element are disposed inside the plug cap housing.

In one embodiment, the magnetic element is a neodymium-iron-boron magnet and its working temperature can reach to 150° C. (Celsius).

In one embodiment, the magnetic element is a ferrite magnet and its working temperature can reach to 80° C.; (Celsius).

In one embodiment, the magnetic element is a samarium rubidium magnet and its working temperature can reach to 350° C. (Celsius).

In one embodiment, a material of the magnetic shielding conductive element is a metal or an alloy with good electroconductivity.

In one embodiment, a magnetic shielding conductive element comprises a first material and a second material, wherein the second material covers the first material, and the second material is a metal or an alloy with good electroconductivity.

In one embodiment, the metal is copper, aluminum, gold or silver.

To achieve the above objective, the present disclosure further discloses an ignition accelerator. The ignition accelerator comprises a magnetic shielding conductive element and a magnetic element. The magnetic shielding conductive element has a first disposing portion and a second disposing portion, wherein one end of the igniter is disposed inside the first disposing portion and electrically connected with the magnetic shielding conductive element. The magnetic element is disposed at the second disposing portion and has a north-seeking pole and a south-seeking pole, wherein the north-seeking pole is located at one side of the magnetic element near the igniter, and the south-seeking pole is located at another side of the magnetic element away from the igniter. The magnetic shielding conductive element shields a magnetic force of the magnetic element in a direction toward the igniter.

As mentioned above, in the car ignition device of the invention, by the structural design of disposing the magnetic element on the magnetic shielding conductive element, orienting the north-seeking pole of the magnetic element in the direction toward the spark plug, and orienting the south-seeking pole of the magnetic element away from the spark plug, the free electrons that constitute the current may be accelerated through at the moment when the spark plug generates the electric arc through the magnetic force effect of the magnetic element. So, it can break through the limit of the supply voltage and dramatically increase the peak gap voltage at the moment of the generation of the electric arc, the oil gas fuel in the engine cylinder can be ignited with the faster and more stable electric arc to achieve the complete combustion, reduce emissions of harmful gases and improve the effect of the horse power. In addition, the car ignition device of the invention further uses the magnetic shielding conductive element to shield the magnetic force of the magnetic element in a direction toward the spark plug, so that the chips generated by the high-temperature caused by electrical breakdown cannot be attached to the electrode, the ignition efficiency can be thus improved, and the car is less free from jittering upon idling.

In addition, in the ignition accelerator of the invention, by the design of disposing the magnetic element on the magnetic shielding conductive element, orienting the north-seeking pole of the magnetic element in the direction toward the igniter, orienting the south-seeking pole of the magnetic element away from the spark plug, and shielding the magnetic force of the magnetic element by the magnetic shielding conductive element in the direction of toward the igniter, the ignition accelerator of the invention greatly increases the peak gap voltage of the igniter at the moment of the generation of the electric arc, and also shortens the ignition time and improves the ignition efficiency of the igniter.

BRIEF DESCRIPTION OF THE DRAWINGS

The accompanying drawings are included to provide a further understanding of embodiments of the present application, which constitutes a part of the specification, illustrate embodiments of the present disclosure is used, together and explain the principles of the present disclosure with the description. Apparently, the drawings in the following description are only some embodiments of the present disclosure, those of ordinary skill in the art is concerned, without any creative effort, and may also obtain other drawings based on these drawings. In the drawings.

DETAILED DESCRIPTION OF THE INVENTION

Figure 1A:
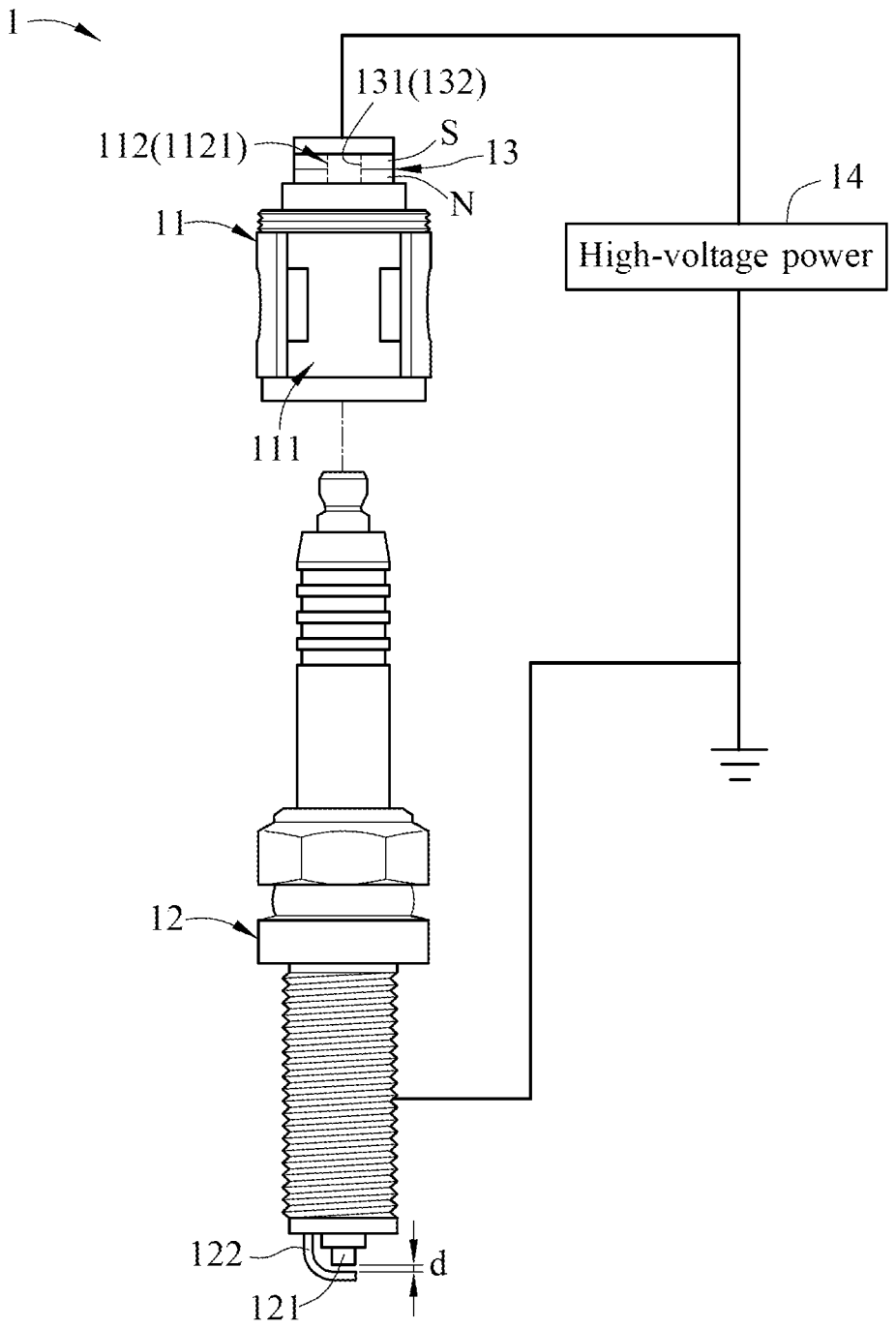
FIGS. 1A and 1B are respectively different schematic views showing a car ignition device according to an embodiment of the invention.

Specific structural and functional details disclosed herein are merely representative and are for purposes of describing example embodiments of the present disclosure. However, the present disclosure may be embodied in many alternate forms, and should not be interpreted as being limited to the embodiments set forth herein.

In the description of the present disclosure, it is to be understood that the term "center", "lateral", "upper", "lower", "left", "right", "vertical", "horizontal", "top", "bottom", "inner", "outer" and other indicated orientation or positional relationships are based on the location or position relationship shown in the drawings, and are for convenience of description of the present disclosure only and to simplify the description, and not indicate or imply that refers to devices or elements must have a specific orientation, the orientation of a particular configuration and operation, therefore, cannot be construed as limiting the present disclosure. In addition, the terms "first", "second" are used to indicate or imply relative importance or the number of technical features specified implicitly indicated the purpose of description and should not be understood. Thus, there is defined "first", "second" features may be explicitly or implicitly include one or more of the features. In the description of the present disclosure, unless otherwise specified, the meaning of "more" is two or more. Further, the term "comprising" and any variations thereof are intended to cover non-exclusive inclusion.

In the description of the present disclosure, it is noted that, unless otherwise expressly specified or limited, the terms "mounted", "connected to", "connected" are to be broadly understood, for example, may be a fixed connection, may be a detachable connection, or integrally connected; may be a mechanical connector may be electrically connected; may be directly connected, can also be connected indirectly through intervening structures, it may be in communication the interior of the two elements. Those of ordinary skill in the art, be appreciated that the specific circumstances of the specific meanings in the present disclosure.

The terminology used herein is for describing particular embodiments only and is not intended to limit embodiments to an exemplary embodiment. Unless the context clearly indicates otherwise, singular forms as used herein, "a", "an" are intended to include the plural. It should also be understood that, as used herein the term "comprising" and/or "comprising", as used herein, specify the presence of stated features, integers, steps, operations, elements, and/or components, but do not preclude the presence or addition of one or more other features, integers, steps, operations, elements, components, and/or combinations thereof.

This disclosure will be further described in detail with reference to the accompanying drawings and specific embodiments below.

FIG. 1A is a schematic view showing a car ignition device according to an embodiment of the invention. As shown in FIG. 1A, a car ignition device 1 includes a magnetic shielding conductive element 11, a spark plug 12 and a magnetic element 13. In addition, the car ignition device 1 of this embodiment may further include a high-voltage power 14.

The magnetic shielding conductive element 11 has a first disposing portion 111 and a second disposing portion 112, and one end of the spark plug 12 is disposed inside the first disposing portion 111 of the magnetic shielding conductive element 11 and electrically connected with the magnetic shielding conductive element 11. In this embodiment, the first disposing portion 111 is located at the bottom surface of the magnetic shielding conductive element 11 and includes a slot, and the spark plug 12 may be inserted inside the slot, so that the magnetic shielding conductive element 11 may be connected and fixed to the spark plug 12 and is electrically connected with the spark plug 12. In addition, the second disposing portion 112 of this embodiment is located at another side of the magnetic shielding conductive element 11 away from the spark plug 12, and is T-shaped.

The magnetic shielding conductive element 11 is made of metal or an alloy with good electroconductivity. Alternatively, the magnetic shielding conductive element 11 may include a first material (inner layer) and a second material (outer layer), and the second material covers the first material. The first material may be metal, an alloy or non-metal, and the second material may be metal or an alloy with good electroconductivity, but this invention is not limited thereto. There are mainly two kinds of magnetic shielding materials, wherein one of which works based on the magnetic reflection principle, and the other of which works according to the magnetic absorption principle. Herein, the selected magnetic shielding material is the magnetic reflection metal, such as copper, aluminum, gold, or silver. In addition, if the alloy is selected, it may be, for example, an iron nickel alloy. Pure copper is taken as an example of the material of the magnetic shielding conductive element 11 in this embodiment. Copper has good electroconductivity, and has good magnetic shielding (magnetic reflection) effect. Moreover, it can be easily obtained and machined, and is suitable for serving as a material of the magnetic shielding conductive element 11.

Specifically speaking, the first disposing portion 111 of the magnetic shielding conductive element 11 in this embodiment may cover the spark plug 12, so that the magnetic shielding conductive element 11 may be electrically connected with one end of the spark plug 12, and the other end of the spark plug 12 has two electrodes, that is, a center electrode 121 electrically connected with the magnetic shielding conductive element 11, and a grounding electrode 122 spaced apart from the center electrode 121 by a gap d. When the spark plug 12 is energized, the gap d between the center electrode 121 and the grounding electrode 122 may have a gap voltage (not labeled). When the gap voltage is high enough, an electric arc may be generated between the center electrode 121 and the grounding electrode 122 of the spark plug 12.

The magnetic element 13 is disposed on the second disposing portion 112 of the magnetic shielding conductive element 11. The magnetic element 13 has a north-seeking pole N and a south-seeking pole S. Herein, the north-seeking pole N is located at one side of the magnetic element 13 near the spark plug 12, and the south-seeking pole S is located at another side of the magnetic element 13 away from the spark plug 12. The magnetic element 13 may be, for example, a neodymium-iron-boron (NdFeB) magnet, or a ferrite magnet, but this invention is not limited thereto. The second disposing portion 112 of the magnetic shielding conductive element 11 in this embodiment away from one side of the spark plug 12 is T-shaped, and has an outer peripheral surface 1121. The magnetic element 13 has an inner circumferential surface 132 facing the outer peripheral surface 1121 of the second disposing portion 112, and the magnetic element 13 is surroundingly disposed on the outer peripheral surface 1121. Specifically speaking, the magnetic element 13 in this embodiment is an annular body and the middle portion of the annular body has a through hole 131. The second disposing portion 112 of the magnetic shielding conductive element 11 passes through the through hole 131, and the outer peripheral surface 1121 of the magnetic shielding conductive element 11 is in surface contact with the inner circumferential surface 132 constituted by the through hole 131 of the magnetic element 13. In addition to being conductive, the magnetic shielding conductive element 11 may further shield the magnetic force of the magnetic element 13 in the direction toward the spark plug 12, so that the magnetic force of the magnetic element 13 does not affect the generation of the electric arc of the spark plug 12, thereby increasing the ignition efficiency of the spark plug 12.

The high-voltage power 14 is electrically connected with the magnetic shielding conductive element 11 and the spark plug 12, respectively. Herein, one end of the high-voltage power 14 is electrically connected with the magnetic shielding conductive element 11, and the other end thereof is electrically connected with the grounding electrode 122 of the spark plug 12. The high-voltage power 14 may be controlled to switch between a power-on state and a power-off state. When the high-voltage power 14 is in the power-on state, the electric field intensity provided by the gap voltage between the center electrode 121 and the grounding electrode 122 is strong enough to cause electrical breakdown, so that the electric arc is generated between the center electrode 121 and the grounding electrode 122 of the spark plug 12 to ignite the oil gas to generate the power for the engine and make the car movable. Herein, the electric arc is generated in a direction from the grounding electrode 122 to the center electrode 121. In addition, when the high-voltage power 14 is in the power-off state, the electric field intensity provided by the gap voltage between the center electrode 121 and the grounding electrode 122 is far less than that sufficient to cause electrical breakdown, so that the electric arc is generated between two electrodes of the spark plug 12, and the engine does not generate the power.

Figure 1B:
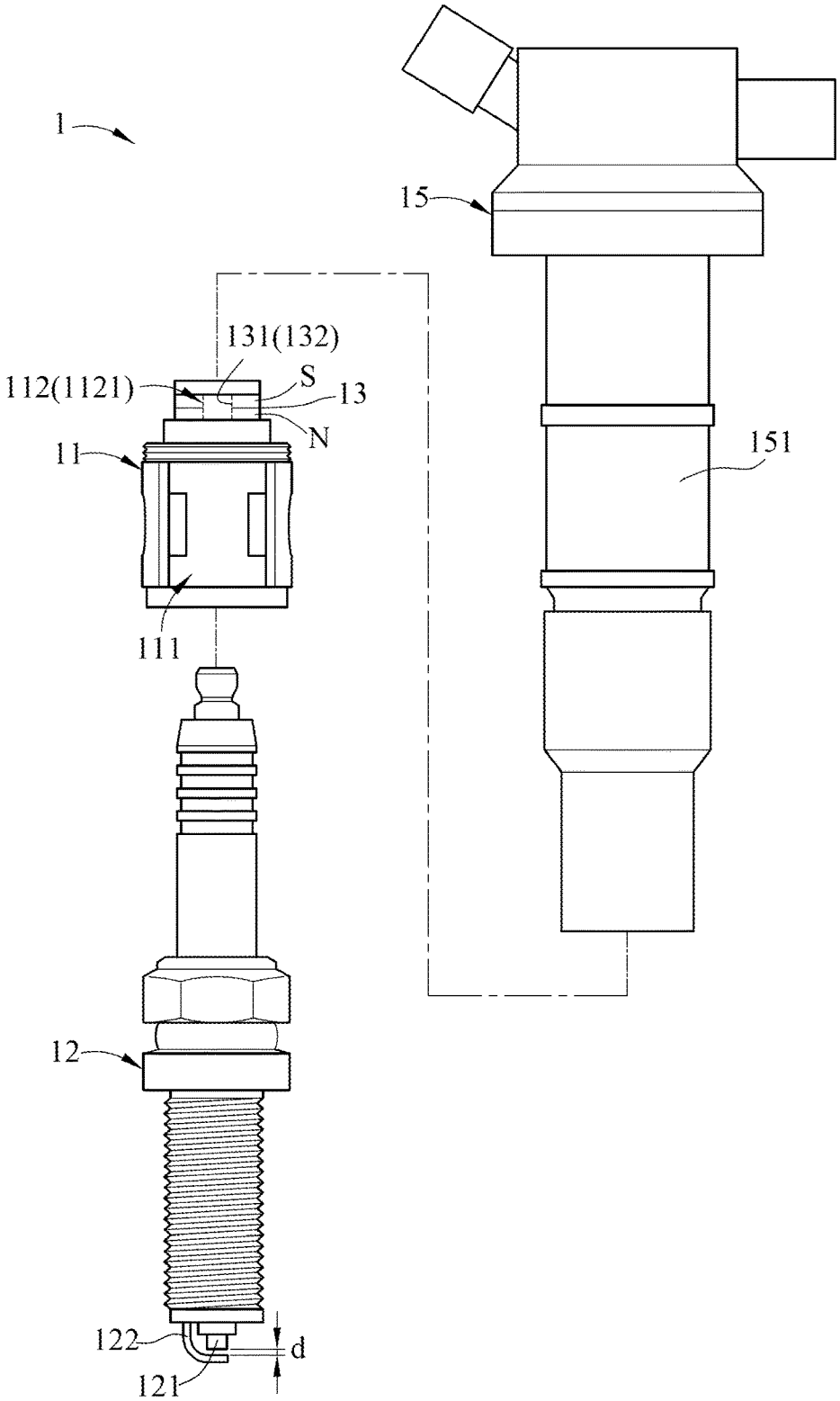

FIG. 1B is another schematic view showing a car ignition device according to an embodiment of the invention. As shown in FIG. 1B, in addition to the magnetic shielding conductive element 11, the spark plug 12, the magnetic element 13 and the high-voltage power 14 (not shown in FIG. 1B) shown in FIG. 1A, the car ignition device 1 of this embodiment may further include a plug cap unit 15.

The plug cap unit 15 has a plug cap housing 151. The material of the plug cap housing 151 is, for example, an insulator, such as rubber, plastic or the like, and the high-voltage power 14 and the magnetic shielding conductive element 11 are disposed inside the plug cap housing 151. In some embodiments, the plug cap unit 15 may further have an elastic member (not shown in FIG. 1B), the elastic member is disposed inside the plug cap housing 151, and the plug cap housing 151 may cover the magnetic shielding conductive element 11 (and one end of the spark plug 12), so that the magnetic shielding conductive element 11 may be electrically connected with the high-voltage power 14 located inside the plug cap housing 151 through the elastic member. In some embodiments, the elastic member may be a helical spring, but this invention is not limited thereto.

Figure 2:
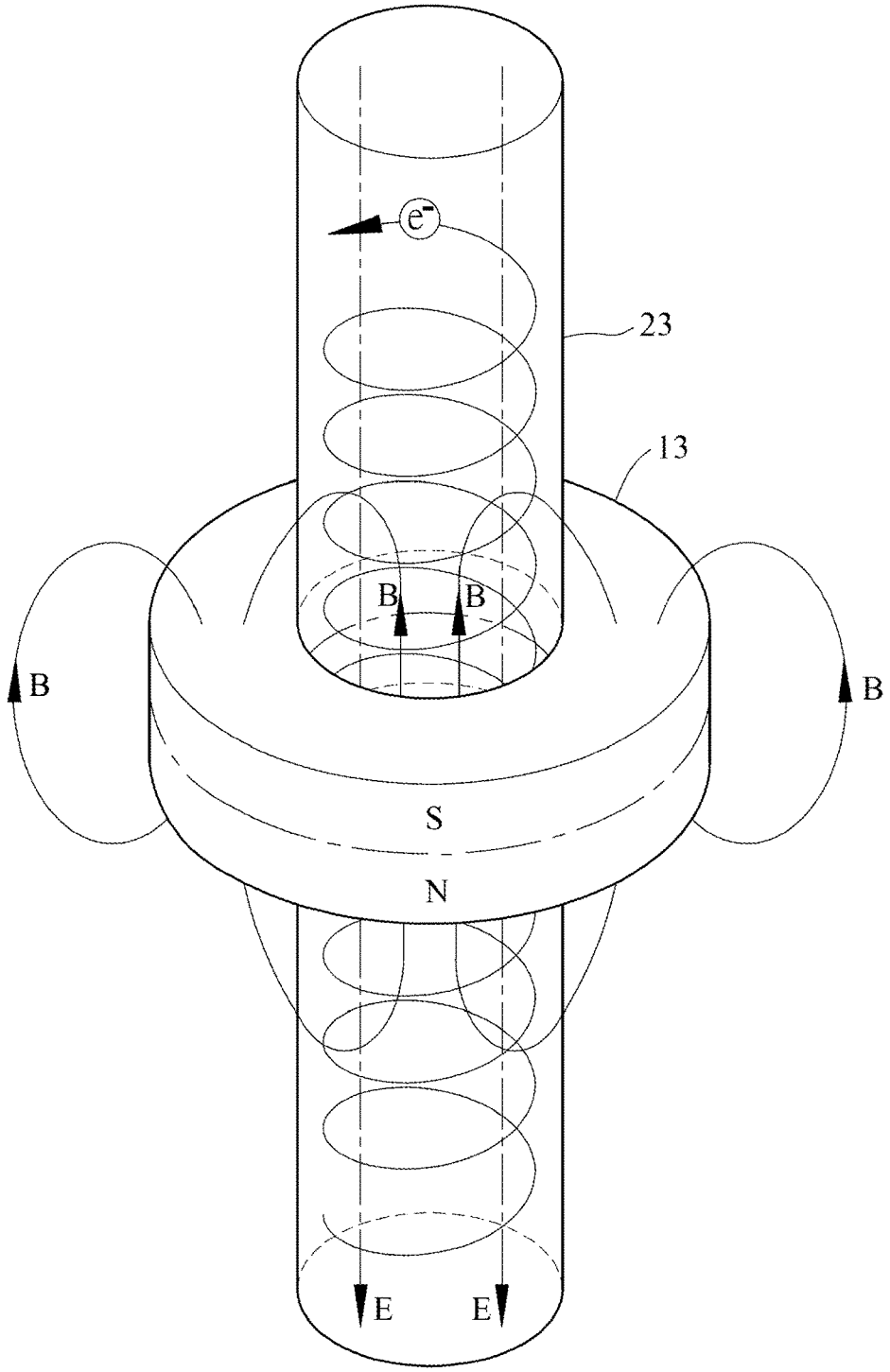
FIG. 2 is a schematic view showing that the magnetic field, generated by the magnetic element of an embodiment, accelerates free electrons passing through the magnetic shielding conductive element in a helical path when the electric arc is generated.

Please refer to FIG. 2, wherein FIG. 2 is a schematic view showing that the magnetic field, generated by the magnetic element 13 of an embodiment, accelerates free electrons passing through the magnetic shielding conductive element 11 in a helical path when the electric arc is generated.

Before the two electrodes 121 and 122 of the spark plug 12 are ignited, owing to the high-intensity magnetic field B of the magnetic element 13, the electrons and holes of the magnetic shielding conductive element 11 are separated and accumulated on the upper and lower sides of the magnetic shielding conductive element 11 relative to the magnetic element 13, wherein the electrons are accumulated on the side close to the north magnetic N of the magnetic element 13 (the lower side in FIG. 1A) and the holes are accumulated on the side close to the south magnetic S of the magnetic element 13 (the upper side in FIG. 1A). As shown, at the moment when the electric field intensity provided by the gap voltage between the center electrode 121 and the grounding electrode 122 is strong enough to cause electrical breakdown to generate the electric arc, owing to the attraction of the hole accumulated on the upper side, then a large amount of free electrons e- can pass through the plasmaed insulating medium through the grounding electrode 122, and can sequentially move along the path of the center electrode 121 and the magnetic shielding conductive element 11 (and the elastic member) (see FIG. 2) toward the high-voltage power 14 to form the electron flow (FIG. 2 schematically shows only one free electron e-). Therefore, the free electrons e- passing through the magnetic shielding conductive element 11 can speed up with the helical path, and a pump-like effect is formed together with the grounding electrode 122, which is forced to replenish more free electrons e- to the center electrode 121. Thus, the instantaneous current value of the electric arc is greatly increased, so that the maximum value of the gap voltage between the two electrodes 121 and 122 greatly increases synchronously with the increase of the instantaneous current value at the moment of the formation of the electric arc.

Figure 3:
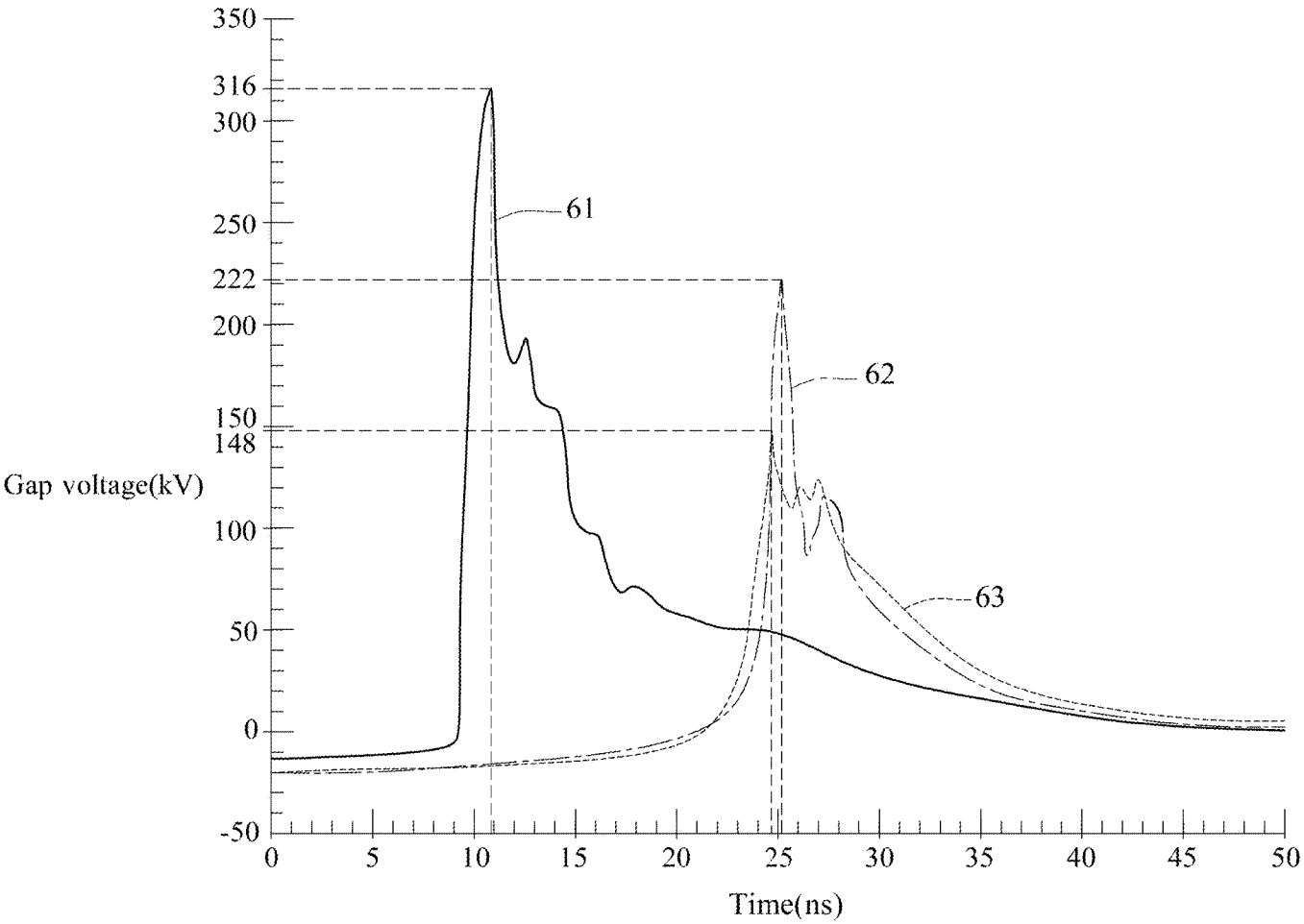
FIG. 3 is a schematic chart showing comparison between the gap voltages versus the time before and after the electric arc is generated between the center electrode of the spark plug of an embodiment and a grounding electrode.

Please refer to FIG. 3, FIG. 3 is a schematic chart showing comparison between the gap voltages versus the time before and after the electric arc is generated between the center electrode 121 and the grounding electrode 122 of the spark plug 12 of an embodiment. Referring to FIG. 3, a curve 61 is a curve showing the variation of the gap voltage with time before and after the generation of the electric arc when the magnetic element 13 of an implementation aspect of the invention employs a neodymium-iron-boron magnet and its working temperature can reach to 150° C. (Celsius); a curve 62 is a curve showing the variation of the gap voltage with time before and after the generation of the electric arc when the magnetic element 13 of another implementation aspect of the invention employs the ferrite magnet and its working temperature can reach to 80° C. (Celsius); and a curve 63 is a curve of the gap voltage of the conventional car ignition device before and after the generation of the electric arc with time. In addition, in some embodiments, the magnetic element is a samarium rubidium magnet and its working temperature can reach to 350° C. (Celsius).

As shown in FIG. 3, the peak gap voltages for the curve 61, curve 62, and curve 63 are respectively 316 kV, 222 kV, and 148 kV, and when the magnetic element 13 employs the neodymium-iron-boron magnet, the voltage from 0 V to the peak gap voltage of 316 kV only takes shorter than 5 ns, but the voltage from 0 V to the peak gap voltage in the conventional car ignition device takes much longer than 5 ns. Therefore, in the car ignition device 1 of this embodiment, if the magnetic element 13 employs the neodymium-iron-boron magnet, then as compared with the conventional ignition device, the peak gap voltage can be increased by more than one time (113.5%), the electric arc can be generated in a shorter period of time. In addition, compared with the conventional ignition device, even if the magnetic element 13 employs the ferrite magnet, the peak gap voltage thereof may also be increased by 50%.

Therefore, the car ignition device 1 of this embodiment can break the limitation of the supply voltage of the high-voltage power 14, and the peak gap voltage is greatly increased at the moment of the generation of the electric arc, so that the fuel in the engine cylinder can be ignited with the faster and more stable electric arc to achieve the objective of complete combustion, to further reduce emissions of harmful gases and improve energy availability, and to make cars more fuel-efficient and more environmentally protective. In addition, the electric arc generated by the spark plug 12 can be generated in a shorter period of time (when the magnetic element 13 employs the neodymium-iron-boron magnet), and the increase of the peak gap voltage can instantaneously ignite the oil gas and perform the powerful work on the engine piston with the explosive way, thereby improving the horse power of the engine. In addition, when the peak gap voltage is increased, the temperature of explosion and combustion of the oil-gas is also high, wherein the higher temperature also removes carbon deposits of the engine room, thereby keeping the engine running at higher efficiency.

In addition, because the high temperature generated by the spark plug 12 due to the electrical breakdown may cause parts of the electrodes to melt and generate chips, these chips may be attached to the center electrode 121 or the grounding electrode 122 (possibly due to the magnetic force), thereby making the gap between the two electrodes become smaller (the ignition distance becomes smaller), and the impedance between the two electrodes also increases. Thus, the voltage required to ignite is not enough or the current is too small, so that the tip discharge effect is poor. Therefore, the car ignition device 1 of this embodiment uses the magnetic shielding conductive element 11 to shield the magnetic force of the magnetic element 13 in the direction toward the spark plug 12. As a result, the chips cannot be attached to the center electrode 121 or the grounding electrode 122 due to the magnetism, and thus the ignition efficiency may also be improved, so that the car is less free from jittering upon idling.

In addition, the invention further provides an ignition accelerator which cooperates with an igniter, and includes a magnetic shielding conductive element and a magnetic element. The magnetic shielding conductive element has a first disposing portion and a second disposing portion, and one end of the igniter is disposed inside the first disposing portion and is electrically connected with the magnetic shielding conductive element. The magnetic element is disposed at the second disposing portion, the magnetic element has a north-seeking pole and a south-seeking pole, the north-seeking pole is located at the magnetic element near one side of the igniter, and the south-seeking pole is located at another side of the magnetic element away from the igniter. The magnetic shielding conductive element shields the magnetic force of the magnetic element in the direction toward the igniter.

In some embodiments, the igniter may be the above-mentioned spark plug 12; in some embodiments, the igniter may be the ignition device of the gas stove; and the igniter may be the ignition device of the gas water heater, wherein the implementation aspects of the above-mentioned igniter are only examples, and the present invention should not be limited thereto.

In addition, other technical contents of the magnetic shielding conductive element and the relative relationship with the magnetic element can refer to the above-mentioned magnetic shielding conductive element 11 and the magnetic element 13, so detailed descriptions thereof will be omitted here. With the above-mentioned design, the ignition accelerator of the invention greatly increases the peak gap voltage of the igniter at the moment of the generation of the electric arc, and also shortens the ignition time and improves the ignition efficiency of the igniter.

In summary, in the car ignition device of the invention, by the structural design of disposing the magnetic element on the magnetic shielding conductive element, orienting the north-seeking pole of the magnetic element in the direction toward the spark plug, and orienting the south-seeking pole of the magnetic element away from the spark plug, the free electrons that constitute the current may be accelerated through at the moment when the spark plug generates the electric arc through the magnetic force effect of the magnetic element. So, it can break through the limit of the supply voltage and dramatically increase the peak gap voltage at the moment of the generation of the electric arc, the oil gas fuel in the engine cylinder can be ignited with the fast and stable electric arc to achieve the complete combustion, reduce emissions of harmful gases and improve the effect of the horse power. In addition, the car ignition device of the invention further uses the magnetic shielding conductive element to shield the magnetic force of the magnetic element in a direction toward the spark plug, so that the chips generated by the high-temperature caused by electrical breakdown cannot be attached to the electrode, the ignition efficiency can be thus improved, and the car is less free from jittering upon idling.

In addition, in the ignition accelerator of the invention, by the design of disposing the magnetic element on the magnetic shielding conductive element, orienting the north-seeking pole of the magnetic element in the direction toward the igniter, orienting the south-seeking pole of the magnetic element away from the spark plug, and shielding the magnetic force of the magnetic element by the magnetic shielding conductive element in the direction of toward the igniter, the ignition accelerator of the invention greatly increases the peak gap voltage of the igniter at the moment of the generation of the electric arc, and also shortens the ignition time and improves the ignition efficiency of the igniter.

Although the present disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present disclosure.

What is claimed is:

1. A car ignition device, comprising:

a magnetic shielding conductive element having a first disposing portion and a second disposing portion;

a spark plug having one end disposed inside the first disposing portion, and electrically connected with the magnetic shielding conductive element; and a magnetic element, which is disposed at the second disposing portion and has a north-seeking pole and a south-seeking pole, wherein the north-seeking pole is located at one side of the magnetic element near the spark plug, and the south-seeking pole is located at another side of the magnetic element away from the spark plug;

wherein the magnetic shielding conductive element shields a magnetic force of the magnetic element in a direction toward the spark plug.

2. The car ignition device according to claim 1, wherein the first disposing portion comprises a slot.

3. The car ignition device according to claim 1, wherein the second disposing portion has an outer peripheral surface, and the magnetic element is surroundingly disposed on the outer peripheral surface.

4. The car ignition device according to claim 3, wherein the magnetic element is an annular body and has a through hole, and the second disposing portion passes through the through hole.

5. The car ignition device according to claim 4, wherein the through hole of the magnetic element forms an inner circumferential surface, and the inner circumferential surface is in surface contact with the outer peripheral surface.

6. The car ignition device according to claim 1, wherein the other end of the spark plug has two electrodes, and a gap is formed between the electrodes.

7. The car ignition device according to claim 1, further comprising:

a high-voltage power electrically connected with the magnetic shielding conductive element and the spark plug, wherein when the high-voltage power is in a power-on state, the spark plug generates an electric arc.

8. The car ignition device according to claim 7, further comprising:

a plug cap unit having a plug cap housing, wherein the high-voltage power and the magnetic shielding conductive element are disposed inside the plug cap housing.

9. The car ignition device according to claim 1, wherein the magnetic element is a neodymium-iron-boron magnet and its working temperature can reach to 150° C. (Celsius).

10. The car ignition device according to claim 1, wherein the magnetic element is a ferrite magnet and its working temperature can reach to 80° C. (Celsius).

11. The car ignition device according to claim 1, wherein the magnetic element is a samarium rubidium magnet and its working temperature can reach to 350° C. (Celsius).

12. The car ignition device according to claim 1, wherein a material of the magnetic shielding conductive element is a metal or an alloy with good electroconductivity.

13. The car ignition device according to claim 12, wherein the metal is copper, aluminum, gold or silver.

14. The car ignition device according to claim 1, wherein the magnetic shielding conductive element comprises a first material and a second material, wherein the second material covers the first material, and the second material is a metal or an alloy with good electroconductivity.

15. The car ignition device according to claim 14, wherein the metal is copper, aluminum, gold or silver.

* * * * *